US006569819B2

(12) United States Patent
Yagishita et al.

(10) Patent No.: US 6,569,819 B2
(45) Date of Patent: May 27, 2003

(54) LUBRICANT COMPOSITIONS

(75) Inventors: Kazuhiro Yagishita, Yokohama (JP); Jinichi Igarashi, Yokohama (JP); Osamu Kurosawa, Yokohama (JP)

(73) Assignee: Nippon Mitsubishi Oil Corporation, Tokyo (JP)

( * ) Notice: Subject to any disclaimer, the term of this patent is extended or adjusted under 35 U.S.C. 154(b) by 0 days.

(21) Appl. No.: 09/964,970

(22) Filed: Sep. 27, 2001

(65) Prior Publication Data

US 2002/0119896 A1 Aug. 29, 2002

(30) Foreign Application Priority Data

Sep. 28, 2000 (JP) ..... 2000-295600

(51) Int. Cl.[7] ..... C10M 133/56; C10M 149/12

(52) U.S. Cl. ..... 508/291; 508/373; 508/376; 508/391; 508/469; 508/502; 508/586

(58) Field of Search ..... 508/291

(56) References Cited

U.S. PATENT DOCUMENTS

| | | | | | |
|---|---|---|---|---|---|
| 2,568,876 | A | | 9/1951 | White et al. | |
| 3,185,704 | A | | 5/1965 | Kahn et al. | |
| 3,216,936 | A | | 11/1965 | Le Suer | |
| 3,367,943 | A | * | 2/1968 | Miller et al. | 508/291 |
| 3,415,750 | A | | 12/1968 | Anzenberger | |
| 4,137,185 | A | * | 1/1979 | Gardiner et al. | 252/402 |
| 4,200,545 | A | | 4/1980 | Clason et al. | |
| 4,482,464 | A | * | 11/1984 | Karol et al. | 508/291 |
| 4,521,318 | A | * | 6/1985 | Karol | 508/291 |
| 4,612,132 | A | | 9/1986 | Wollenberg et al. | |
| 4,636,322 | A | | 1/1987 | Nalesnik | |
| 4,648,886 | A | | 3/1987 | Buckley, III et al. | |
| 4,663,063 | A | | 5/1987 | Davis | |
| 4,663,064 | A | * | 5/1987 | Nalesnik et al. | 508/291 |
| 4,699,724 | A | | 10/1987 | Nalesnik et al. | |
| 4,708,809 | A | | 11/1987 | Davis | |
| 4,713,189 | A | | 12/1987 | Nalesnik et al. | |
| 4,780,111 | A | | 10/1988 | Dorer et al. | |
| 4,839,073 | A | | 6/1989 | Gutierrez et al. | |
| 5,182,038 | A | * | 1/1993 | Shirodkar et al. | 508/291 |
| 5,221,491 | A | * | 6/1993 | Roper et al. | 548/546 |
| 5,445,750 | A | * | 8/1995 | Chafetz et al. | 508/291 |
| 5,460,740 | A | * | 10/1995 | Migdal et al. | 508/291 |
| 6,306,801 | B1 | * | 10/2001 | Yagishita et al. | 508/292 |

FOREIGN PATENT DOCUMENTS

| | | |
|---|---|---|
| EP | 0 451 397 A1 | 10/1991 |

* cited by examiner

*Primary Examiner*—Ellen M. McAvoy
(74) *Attorney, Agent, or Firm*—Akin, Gump, Strauss, Hauer & Feld, L.L.P.

(57) ABSTRACT

Lubricant compositions comprise a lubricant base oil, and (A) a mono substituted amide type bissuccinimide in an amount from 0.5 to 20 percent by mass, (B) zinc dithiophosphate in an amount from 0.05 to 0.3 percent by mass of phosphorus, and (C) a metal-based detergent in an amount form 0.5 to 4.0 percent by mass of sulfated ash, based on the total mass of the composition. Lubricant compositions preferably further comprises (D) a dispersant type viscosity index improver in an amount from 0.1 to 20 percent by mass, based on the total mass of the composition.

6 Claims, No Drawings

LUBRICANT COMPOSITIONS

BACKGROUD OF THE INVENTION

1. Field of the Invention

This invention relates to lubricant compositions, and more particularly to such a lubricant composition which is suitable as engine oils and highly effective in inhibiting sludge formation.

2. Description of the Prior Art

In gasoline engines, sludge is formed by the oxidative deterioration of the engine oil at elevated temperatures or the reaction between the engine oil and unburned fuel or blow-by gases (NOx) Such sludge clogs the oil passages and valves and increases the viscosity of the engine oil, leading to malfunctions of the engine. Therefore, engine oils have been demanded to have the ability to inhibit the formation of sludge as much as possible. Particularly due to the recent trend of high-powered engines and the decreased volume of oil pans for energy-saving, the engine oils have been used under severe conditions and thus been demanded to be highly effective in inhibiting sludge formation.

Generally, gasoline engine oils are produced by blending a lubricant base oil with additives such as ashless-dispersants, wear inhibitors, and metal-based detergents. In the conventional blend formulation, polybutenyl succinimides have been used as ashless dispersants.

However, known polybutenyl succinimides are too insufficient in terms of the sludge inhibiting effect to establish a technology of prolonging the life of engine oils.

In view of the foregoing, the object of the present invention is to provide a lubricant composition which has an excellent sludge inhibiting effect.

BRIEF SUMMARY OF THE INVENTION

According to the present invention, there is provided a lubricant composition which comprises a lubricant base oil and:

(A) a mono substituted amide type bissuccinimide in an amount of 0.5 to 20 percent by mass;

(B) zinc dithiophosphate in an amount of 0.05 to 0.3 percent by mass of phosphorus; and (C) a metal-based detergent in an amount of 0.5 to 4.0 percent by mass of sulfated ash, based on the total mass of the composition.

A lubricant composition according to the present invention contains preferably (D) a dispersant-type viscosity index improver in an amount of 0.1 to 20 percent by mass based on the total mass of the composition.

DETAILED DESCRIPTION OF THE INVENTION

The present invention will be described in more details below.

Eligible lubricant base oils in the lubricant composition of the present invention are any mineral oils and/or synthetic oils which are used as base oil of conventional lubricants.

Specific examples of mineral oils which may be used include paraffinic- and naphthenic-mineral oils which are produced by subjecting lubricant fractions resulting from the atmospheric distillation and the vacuum distillation of crude oil to one or more refining processes such as solvent deasphalting, solvent extraction, hydrocracking, solvent dewaxing, catalytic dewaxing, hydrorefining, sulfuric acid washing, and clay treatment in suitable combination; and n-paraffinic mineral oils. In the case of using two or more of the refining processes, the processes can be combined in any suitable order or one particular refining process can be repeated a plurality of times under different conditions.

Although not restricted, examples of synthetic oils are one or more compounds selected from poly-α-olefins such as 1-octene oligomer, 1-decene oligomer, and ethylene-propylene oligomer, and hydrides thereof, isobutene oligomers and hydrides thereof, isoparaffins, alkylbenzenes, alkylnaphthalenes, diesters such as ditridecyl glutarate, di-2-ethylhexyl adipate, diisodecyl adipate, ditridecyl adipate, and di-2-ethylhexyl sebacate, polyol esters such as trimethylolpropane caprylate, trimethylolpropane pelargonate, pentaerythritol-2-ethyl hexanoate, and pentaerythritol pelargonate, polyoxyalkylene glycol, dialkyldiphenyl ether, and polyphenyl ether.

Needless to mention, there may be used a mixture of the mineral oils and the synthetic oils mixed in any ratio, i.e., semi-synthetic oils as a base oil for the present invention.

No particular limitation is imposed on the viscosity of the lubricant base oils. However, the lower limit of kinematic viscosity at 100° C. is preferably 1.0 $mm^2/s$, and more preferably 2.0 $mm^2/s$, while the upper limit is preferably 10 $mm^2/s$, and more preferably 8 $mm^2/s$. The use of a lubricant base oils with a kinematic viscosity at 100° C. of 1.0 $mm^2/s$ or more makes it possible to produce a lubricant composition which can form oil film sufficiently and is more excellent in lubricity and more less in evaporation loss under elevated temperature conditions. The use of a lubricant base oil with a kinematic viscosity at 100° C. of 10 $mm^2/s$ or lower makes it possible to produce a lubricant composition which is reduced in fluid resistance, resulting in less friction resistance at sites to be lubricated.

Although not restricted, a lubricant base oil has a viscosity index of preferably 50 or more, and more preferably 80 or more. The use of a lubricant base oil with a viscosity index of 50 or more makes it possible to produce a lubricant composition having the abilities to both form oil film and reduce fluid resistance.

Although not restricted, a lubricant base oil has a pour point of preferably 0° C. or below, and more preferably −5° C. or below. The use of a lubricant base oil having a pour point of 0° C. or below makes it possible to produce a lubricant composition which does not hinder the engine work.

The lubricant composition of the present invention necessarily contains a lubricant base oil, (A) a mono substituted amide type bissuccinimide, (B) zinc dithiophosphate, and (C) a metal-based detergent.

Specific examples of (A) a mono substituted amide type bissuccinimide are compounds represented by formula (1) below and derivatives thereof:

(1)

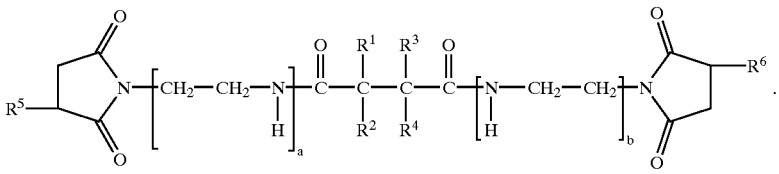

In formula (1), $R^1$, $R^2$ $R^3$, and $R^4$ are each independently hydrogen, an alkyl or alkenyl group having 1 to 24 carbon atoms or an alkoxy group having 1 to 24 carbon atoms.

Specific examples of the alkyl or alkenyl group having 1 to 24 carbon atoms are straight-chain or branched alkyl groups such as methyl, ethyl, propyl, butyl, pentyl, hexyl, heptyl, octyl, nonyl, decyl, undecyl, dodecyl, tridecyl, tetradecyl, pentadecyl, hexadecyl, heptadecyl, octadecyl, nonadecyl, eicosyl, heneicosyl, docosyl, tricosyl, and tetracosyl groups, and straight-chain or branched alkenyl groups such as butenyl, pentenyl, hexenyl, heptenyl, octenyl, nonenyl, decenyl, undecenyl, dodecenyl, tridecenyl, tetradecenyl, pentadecenyl, hexadecenyl, heptadecenyl, octadecenyl, nonadecenyl, eicosenyl, heneicosenyl, docosenyl, tricosenyl, and tetracosenyl groups.

Specific examples of the alkoxy group having 1 to 24 carbon atoms are alkoxy groups of which alkyl may be straight-chain or branched, such as methyloxy (methoxy), ethyloxy (ethoxy), propyloxy (propoxy), butyloxy (butoxy), pentyloxy, hexyloxy, heptyloxy, octyloxy, nonyloxy, decyloxy, undecyloxy, dodecyloxy, tridecyloxy, tetradecyloxy, pentadecyloxy, hexadecyloxy, heptadecyloxy, octadecyloxy, nonadecyloxy, eicosyloxy, heneicosyloxy, docosyloxy, tricosyloxy, and tetracosyloxy groups.

Preferred for $R^1$, $R^2$, $R^3$, and $R^4$ are hydrogen, alkyl groups having 1 to 12 carbon atoms, and alkoxy groups having 1 to 12 carbon atoms with the objective of an excellent detergent effect.

In formula (1), $R^5$ and $R^6$ are each independently a straight-chain or branched alkyl or alkenyl group having 40 to 400 carbon atoms. Preferred for $R^5$ and $R^6$ are branched alkenyl groups derived from polypropylene, polybutene or polyisobutylene each having a number-average molecular weight of preferably 800 to 3500, and more preferably 900 to 2600, and hydrides of these alkenyl groups, i.e., branched alkyl groups. The terms "polybutene" and "polyisobutylene" designate those obtained by polymerizing a butene mixture or a highly purified isobuten using an aluminum chloride based catalyst or a boron fluoride based catalyst. No particular limitation is imposed on the method of producing them.

In formula (1), a and b are each independently an integer of 1 to 5. With the objective of an excellent detergent effect, a and b are each preferable 2 to 4, and more preferably 3 or 4.

No particular limitation is imposed on the method of producing the above-described primary amide type bissuccinimide. However, a preferred method is exemplified as follows.

That is, the method is conducted reacting a monosuccinimide represented by formula (2) below with an organic carboxylic acid represented by formula (3) below:

(2)

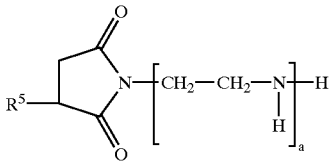

wherein $R^5$ is the same as $R^5$ or $R^6$ in formula (1), and a is the same integer as a or b in formula (2);

(3)

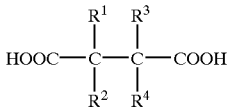

wherein $R^1$, $R^2$, $R^3$, and $R^4$ are each independently the same as those in formula (1).

No particular limitation is imposed on the conditions where the two components are brought in to a reaction. For example, a light lubricant base oil solution containing 2 mols of monosuccinimide of formula (2) is mixed with 1 mol of an organic carboxylic acid of formula (3) wherein $R^1$, $R^2$, $R^3$, and $R^4$ are each hydrogen, i.e., succinic acid or an organic carboxylic acid of formula (3) wherein $R^1$, $R^2$, $R^3$, and $R^4$ are each methyl, i.e., 2,2,3,3-tetramethyl-1,4-butanedicarboxylic acid. The mixture is refluxed under a nitrogen atmosphere at a temperature of 70 to 180° C., preferably 90 to 160° C. for 1 to 5 hours, preferably 2 to 4 hours and then distilled, thereby obtaining a primary amide type bissuccinimide of formula (1) wherein $R^1$, $R^2$, $R^3$, and $R^4$ are each hydrogen.

Derivatives of the above-described mono substituted amide type bissuccinimide are also eligible as Component (A) of the present invention. Specific examples of such derivatives are polycarboxylic acid-modified compounds obtained by bringing the above-described mono substituted amide type bissuccinimide into the reaction with polycarboxylic acid having 2 to 30 carbon atoms, such as oxalic acid, phthalic acid, trimellitic acid, and pyromellitic acid so as to neutralize or amidize the part or whole of the remaining amino and/or imino groups; sulfur-modified compounds obtained by bringing the primary amide type bissuccinimide into the reaction with a sulfuric compound; and boron-modified compounds obtained by modifying the primary amide type bissuccinimide or polycarboxylic- or sulfur-modified compounds thereof with a boric compound, such as boric acid, boric acid salt and borate.

The lower limit content of Component (A) in the lubricant composition of the present invention is 0.5 percent by mass and preferably 1.0 percent by mass based on the total mass of the composition, while the upper limit content is 20 percent by mass and preferably 15 percent by mass, based on the total mass of the composition. Component (A) in an amount of less than 0.5 percent by mass would be poor in the effect of inhibiting sludge formation, while Component (A)

in an amount of exceeding 20 percent by mass would deteriorate the low temperature fluidity of the resulting lubricant composition.

Zinc dithiophosphates, i.e., Component (B) which is one of the essential components of the present invention may be exemplified by compounds represented by formula (4)

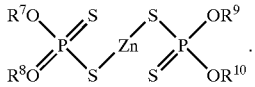

(4)

In formula (4), $R^7$, $R^8$, $R^9$, and $R^{10}$ are each independently an alkyl or aryl group having 1 to 18 carbon atoms or an alkylaryl group having 7 to 18 carbon atoms.

Specific examples of the alkyl group are methyl, ethyl, propyl, butyl, pentyl, hexyl, heptyl, octyl, nonyl, decyl, undecyl, dodecyl, tridecyl, tetradecyl, pentadecyl, hexdecyl, heptadecyl, and octadecyl groups. Particularly alkyl groups having 3 to 8 carbon atoms are preferably used. These alkyl groups may be straight-chain or branched. These alkyl groups include primary and secondary alkyl groups.

A mixture of α-olefins may be used as a raw material so as to introduce $R^7$, $R^8$, $R^9$, and $R^{10}$. In such a case, the resulting compound of formula (4) is a mixture of zinc dialkylthiophosphates which are different in the alkyl structure from each other.

Specific examples of the aryl group are phenyl and naphthyl groups.

Specific examples of the alkylaryl group are tolyl, xylyl, ethylphenyl, propylphenyl, butylphenyl, pentylphenyl, hexylphenyl, heptylphenyl, octylphenyl, nonylphenyl, decylphenyl, undecylphenyl, and dodecylphenyl groups. These alkylaryl groups may be straight-chain or branched and include all positional isomers.

Specific examples of preferred zinc dithiophosphates are zinc dipropyldithiophosphate, zinc dibutyldithiophosphate, zinc dipentyldithiophospahte, zinc dihexyldithiophospahte, zinc diheptyldithiophospahte, and zinc dioctyldithiophospahte, of which alkyl groups may be straight-chain or branched, and mixtures thereof. Furthermore, zinc dialkyldithiophosphates having alkyl groups having different carbon number (3 to 8 carbon atoms) or structure in one molecule are also eligible.

Any suitable methods can be employed for producing Component (B), i.e., zinc dithiophosphate. For example, an alcohol or phenol having hydrocarbon groups corresponding to $R^7$, $R^8$, $R^9$, and $R^{10}$ is reacted with phosphorus pentasulfide so as to produce dithiophosphate. The dithiophosphate is neutralized with zinc oxide thereby obtaining zinc dithiophosphate. The structure of zinc dithiophosphate varies depending on the type of alcohol.

The lower limit content of Component (B) in the lubricant composition of the present invention is 0.05 percent by mass of phosphorus, and preferably 0.07 percent by mass of phosphorus, based on the total mass of the composition, while the upper limit content is 0.3 percent by mass of phosphorus, and preferably 0.25 percent by mass of phosphorus, based on the total mass of the composition. Composition (B) of less than 0.05 percent by mass of phosphorus would be poor in the enhancement of inhibiting sludge formation, while Composition (B) in excess of 0.3 percent by mass of phosphorus would deteriorate the oxidation stability of the resulting lubricant composition.

Component (C) is a metal-based detergent. No particular limitation is imposed on the total base number of the metal-based detergent. However, the lower limit of the total base number is preferably 20 mgKOH/g, and more preferably 100 mgKOH/g, while the upper limit is preferably 500 mgKOH/g, and more preferably 450 mgKOH/g. A total base number less than 20 mgKOH/g is not preferred because the oxidation stability of the resulting lubricant composition would be deteriorated, while a total base number in excess of 500 mgKOH/g is not preferred because the storage stability of the resulting composition would be adversely effected. The term "total base number" used herein denotes a total base number measured by the perchloric acid potentiometric titration method in accordance with section 7 of JIS K2501 "Petroleum products and lubricants-Determination of neutralization number".

Specific examples of metal are alkaline metals such as sodium and potassium, alkaline earth metals such as magnesium, calcium, and barium, and zinc. Among these, particularly preferred are alkaline earth metals.

Preferred metal-based detergents for Component (C) are one or more alkaline earth metal-based detergents selected from the group consisting of:

(C-1) alkaline earth metal sulfonates having a total base number of 20 to 500 mgKOH/g;

(C-2) alkaline earth metal phenates having a total base number of 20 to 500 mgKOH/g; and (C-3) alkaline earth metal salicylates having a total base number of 20 to 500 mgKOH/g.

Specific examples of the alkaline earth metal sulfonates are alkaline earth metal salts preferably magnesium salt or calcium salt of an alkyl aromatic sulfonic acid obtained by sulfonating an alkyl aromatic compound having a molecular weight of 100 to 1500, preferably 200 to 700. Specific examples of the alkyl aromatic sulfonic acid are petroleum sulfonic acids and synthetic sulfonic acids.

The petroleum sulfonic acid may be mahogany acid obtained by sulfonating the alkyl aromatic compound contained in the lubricant fraction of mineral oil or by-produced upon production of white oil. The synthetic sulfonic acid may be those obtained by sulfonating alkyl benzene having a straight-chain or branched alkyl group, which may be by-produced from a plant for producing alkyl benzene used as materials of detergents, or sulfonating dinonylnaphthalene. Although not restricted, there may be used fuming sulfuric acid and sulfuric acid as a sulfonating agent.

Specific examples of the alkaline earth metal phenates are alkaline earth metal salts of alkylphenols having at least one straight-chain or branched alkyl group of 4 to 30, preferably 6 to 18 carbon atoms; alkaline earth metal salts of alkylphenolsulfides obtained by reacting an alkylphenol with an elementary sulfur; and alkaline earth metal salts of methylene bisalkylphenols obtained by subjecting an alkylphenol and acetone to a condensation-dehydration reaction. Preferred are calcium phenate and/or magnesium phenate. Particularly preferred is calcium phenate.

Specific examples of alkaline earth metal salicylates are alkaline earth metal salts of alkyl salicylic acid having at least one straight-chain or branched alkyl group of 4 to 30, preferably 6 to 18 carbon atoms. Particularly preferred are magnesium salicylates and/or calcium salicylates.

No particular limitation is imposed on the production method of (C-1) alkaline earth metal sulfonates, (C-2) alkaline earth metal phenates, and (C-3) alkaline earth metal salicylates. In other words, these basic salts may be those obtained by reacting alkylaromatic sulfonic acids, alkylphenols, alkylphenolsuflides, methylene bisalkylphenols or alkyl salicylic acid directly with an alkaline earth metal base such as the oxide or hydroxide of an alkaline earth metal.

Furthermore, the basic salts may be those obtained by converting an alkylaromatic sulfonic acids, alkylphenols, alkylphenolsuflides, methylene bisalkylphenols or alkyl salicylic acid to an alkaline metal salt such as sodium salt and potassium salt and then substituting the alkaline metal by an alkaline earth metal salt so as to obtain a neutral salt which is then heated with an excess alkaline earth metal salt or alkaline earth metal base, i.e., the hydride or oxidide of an alkaline earth metal in the presence of water.

Furthermore, the basic acids may be alkaline earth metal carbonate-containing overbased salts obtained by reacting the above-mentioned basic salt or neutral salt with an alkaline earth metal base in the presence of carbonic acid gas.

Furthermore, the basic acids may be alkaline earth metal borate-containing overbased salts obtained by dispersing an alkaline earth metal base in the above-mentioned basic salt or neutral salt and reacting the dispersant with boric acid, boric acid salt or borate so as to form potassium borate dispersant; or by reacting the above-described alkaline earth metal carbonate-containing overbased salts with boric acid, boric acid salt or borate so as to converting the dispersed alkaline earth metal carbonate to an alkaline earth metal borate.

Specific examples of boric acid are orthoboric acid, metaboric acid, and tetraboric acid. Specific examples of boric acid salt are alkali metal salts, alkaline earth metal salts or ammonium salts of boric acid. More specific examples are lithium borates such as lithium metaborate, lithium tetraborate, lithium pentaborate, lithium perborate; sodium borates such as sodium metaborate, sodium diborate, sodium tetraborate, sodium pentaborate, sodium hexaborate, and sodium octaborate; potassium borates such as potassium metaborate, potassium tetraborate, potassium pentaborate, potassium hexaborate, and potassium octaborate; calcium borates such as calcium metaborate, calcium diborate, tricalcium tetraborate, pentacalcium tetraborate, and calcium hexaborate; magnesium borates such as magnesium metaborate, magnesium diborate, trimagnesium tetraborate, pentamagnesium tetraborate, and magnesium hexaborate; and ammonium borates such as ammonium metaborate, ammonium tetraborate, ammonium pentaborate, and ammonium octaborate. Borates may be esters of boric acid with an alkyl alcohol having 1 to 6 carbon atoms. Specific examples are monomethylborate, dimethylborate, trimethylborate, monoethylborate, diethylborate, triethylborate, monopropylborate, dipropylborate, tripropylborate, monobutylborate, dibutylborate, and tributylborate.

These reactions may be carried out in a solvent, for example, an aliphatic hydrocarbon solvent such as hexane, an aromatic hydrocarbon solvent such as xylene and a light lubricant base oil. Commercially available metallic detergents are usually diluted with a light lubricating base oil. It is preferred to use metal-based detergents of which metal content is within the range of 1.0 to 20 percent by mass, preferably 2.0 to 16 percent by mass.

The lower limit content of Component (C) in the lubricant composition of the present invention is 0.5 percent by mass of sulfated ash, and preferably 0.7 percent by mass of sulfated ash, based on the total mass of the composition, while the upper limit content is 4.0 percent by mass of sulfated ash, and preferably 3.5 percent by mass of sulfated ash, based on the total mass of the composition. Component (C) of less than 0.5 percent by mass of sulfated ash would be poor in the enhancement of inhibiting sludge formation. Component (C) in excess of 4.0 percent by mass of sulfated ash would deteriorate the oxidation stability of the resulting composition.

The term "sulfated ash" used herein denotes the amount of sulfated ash measured in accordance with Section 5 "Testing Method of Sulfated Ash" prescribed in JIS K2272-1985 "Testing Methods for Ash and Sulfated Ash of Crude Oil and Petroleum Products"

The lubricant composition of the present invention as it is exhibits an excellent effect of inhibiting sludge formation but may be blended with dispersant type viscosity index improvers hereinafter referred to as Component (D).

Specific examples of the dispersion type viscosity index improvers are those obtained by introducing an oxygen-containing group into homopolymers and copolymers of one or more monomers selected from compounds represented by formulae (5), (6), and (7), and hydrides of the polymers; and copolymers of (D-1) one or more monomers selected from compounds represented by formulae (8), (9), and (10) and (D-2) one or more monomers selected from compounds represented by formulae (5), (6), and (7) and hydrides of the copolymers.

Formula (5) is represented by

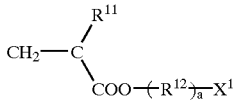

(5)

wherein $R^{11}$ is hydrogen or methyl, $R^{12}$ is an alkylene group having 1 to 18 carbon atoms, $X^1$ is an amine- or heterocyclic-residue having 1 or 2 nitrogen and 0 to 2 oxygen, and a is an integer of 0 or 1.

Specific examples of the alkylene group having 1 to 18 carbon atoms are ethylene, propylene, butylene, pentylene, hexylene, heptylene, octylene, nonylene, decylene, undecylene, dodecylene, tridecylene, tetradecylene, pentadecylene, hexadecylene, heptadecylene, and octadecylene groups, of which alkyl groups may be straight-chain or branched.

Specific examples of the group for $X^1$ are dimethylamino, diethylamino, dipropylamino, dibutylamino, anilino, toluidino, xylidino, acetylamino, benzoylamino, morpholino, pyrolyl, pyridyl, methylpyridyl, pyrolidinyl, piperidinyl, quinonyl, pyrrolidonyl, pyrrolidono, imidazolino, and pyrazino groups.

Formula (6) is represented by

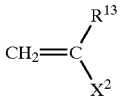

(6)

wherein $R^3$ is hydrogen or methyl and $X^2$ is an amine- or heterocyclic-residue having 1 or 2 nitrogen and 0 to 2 oxygen.

Specific examples of the groups for $X^2$ are dimethylamino, diethylamino, dipropylamino, dibutylamino, anilino, toluidino, xylidino, acetylamino, benzoylamino, morpholino, pyrolyl, pyridyl, methylpyridyl, pyrolidinyl, piperidinyl, quinonyl, pyrrolidonyl, pyrrolidono, imidazolino, and pyrazino groups, and monoalkylethers of polymers of alkyleneoxide having 2 to 4 carbon atoms.

Formula (7) is represented by (7)

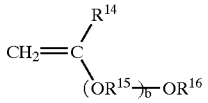

wherein $R^{14}$ is hydrogen or methyl, $R^{15}$ is an alkylene group having 1 to 6 carbon atoms, $R^{16}$ is an alkyl group having 1 to 18 carbon atoms, and b is an integer of 0 to 10.

Specific examples of the alkylene group having 1 to 6 carbon atoms for $R^{15}$ are methylene, ethylene, propylene, butylene, pentylene, and hexylene groups, of which alkyl groups may be straight-chain or branched.

Specific examples of the alkyl group having 1 to 18 carbon atoms for $R^{16}$are methyl, ethyl, propyl, butyl, pentyl, hexyl, heptyl, octyl, nonyl, decyl, undecyl, dodecyl, tridecyl, tetradecyl, pentadecyl, hexadecyl, heptadecyl, and octadecyl groups, all of which may be straight-chain or branched.

Formula (8) is represented by (8)

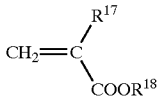

wherein $R^{17}$ is hydrogen or methyl, and $R^{18}$ is an alkyl group having 1 to 18 carbon atoms.

Specific examples of the alkyl group having 1 to 18 carbon atoms for $R^{18}$ are methyl, ethyl, propyl, butyl, pentyl, hexyl, heptyl, octyl, nonyl, decyl, undecyl, dodecyl, tridecyl, tetradecyl, pentadecyl, hexadecyl, heptadecyl, and octadecyl groups, all of which may be straight-chain or branched.

Formula (9) is represented by (9)

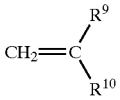

wherein $R^{19}$ is hydrogen or methyl, and $R^{20}$ is a hydrocarbon group having 1 to 12 carbon atoms.

Specific examples of the hydrocarbon group having 1 to 12 carbon atoms for $R^{20}$ are alkyl groups, which may be straight-chain or branched, such as methyl, ethyl, propyl, butyl, pentyl, hexyl, heptyl, octyl, nonyl, decyl, undecyl, and dodecyl groups; alkenyl groups, which may be straight-chain or branched and the position of which the double bond may vary, such as butenyl, pentenyl, hexenyl, heptenyl, octenyl, nonenyl, decenyl, undecenyl, and dodecenyl groups; cycloalkyl groups having 5 to 7 carbon atoms, such as cyclopentyl, cyclohexyl, and cycloheptyl groups; alkylcycloalkyl groups, of which the alkyl group may bonded to any position of the cycloalkyl group, having 6 to 11 carbon atoms, such as methylcyclopentyl, dimethylcyclopentyl, methylethylcyclopentyl, diethylcyclopentyl, methylcyclohexyl, dimethylcyclohexyl, methylethylcyclohexyl, diethylcyclohexyl, methylcycloheptyl, dimethylcycloheptyl, methylethylcycloheptyl, and diethylcycloheptyl groups; aryl groups such as phenyl and naphtyl groups; alkylaryl groups, of which the alkyl group may be straight-chain or branched and bond to any position of the aryl group, having 7 to 12 carbon groups, such as tolyl, xylyl, ethylphenyl, propylphenyl, butylphenyl, pentylphenyl, and hexylphenyl groups; and phenylalkyl groups, of which the alkyl group may be straight-chain or branched, having 7 to 12 carbon atoms, such as benzyl, phenylethyl, phenylpropyl, phneylbutyl, phenylpentyl, and phenylhexyl groups.

Formula (10) is represented by (10)

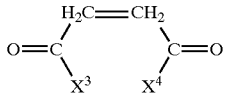

wherein $X^3$ and $X^4$ are each independently hydrogen, an alkylalcohol residue having 1 to 18 carbon atoms represented by the formula —$OR^{21}$ wherein $R^{21}$ is an alkyl group having 1 to 18 carbon atoms or a monoalkylamine residue having 1 to 18 carbon atoms represented by the formula —$NHR^{22}$ wherein $R^{22}$ is an alkyl group having 1 to 18 carbon atoms.

Preferred monomers for Component (D-1) are alkylacrylates having 1 to 18 carbon atoms, alkylmethacrylates having 1 to 18 carbon atoms, olefins having 2 to 20 carbon atoms such as ethylene, propylene and 1-buten, styrene, methylstyrene, maleic anhydride ester, maleic anhydride amide, and mixtures thereof.

Preferred monomers for Component (D-2) are dimethylaminomethylmethacrylate, diethylaminomethylmethacrylate, dimethylaminoethylmethacrylate, diethylaminoethylmethacrylate, 2-methyl-5-vinylpyridine, morpholinomethylmethacrylate, morpholinoethylmethacrylate, N-vinylpyrrolidone, dimethylvinyl amine, diethylvinyl amine, etherified products of vinylalcohol and polyethylene glycol monomethylether, etherified products of vinylalcohol and polyethylene glycol monoethylether, and mixtures thereof.

When one or more monomers selected from compounds (D-1) is copolymerized with one or more monomers selected from compounds (D-2), the molar ratio of (D-1) to (D-2) is arbitrary selected but is within the range of 80:20 to 95:5. Although no particular limitation is imposed on the copolymerization method, such copolymers are generally obtained by radical-solution polymerization of Component (D-1) with Component (D-2) in the presence of a polymerization initiator such as benzoyl peroxide.

Specific examples of Component (D) are dispersion type polymethacrylates, dispersion type ethylene-α-olefin copolymers, and hydrides thereof.

The addition of one or more compounds selected from Components (D), i.e., viscosity index improvers is contributive to the production of a lubricant composition which further excels in the abilities to inhibit sludge formation and to suppress the increase of viscosity occurring when mixed with soot.

No particular limitation is imposed on the molecular weight of Component (D). However, it is preferably selected in view of shear stability. Specifically, the weight-average molecular weight of the dispersion type polymethacrylates is preferably from 5,000 to 500,000, and more preferably 10,000 to 400,000. The weight-average molecular weight of the dispersion type ethylene-α-olefin copolymers are preferably from 800 to 500,000, and more preferably 10,000 to 400,000.

No particular limitation is imposed on the content of ethylene component in the dispersion type ethylene-α-olefin copolymers or hydrides thereof. However, the content of ethylene component is within the range of preferably 30 to 80 percent by mole, and more preferably 50 to 80 percent by mole, based on the total amount of ethylene and a-olefin. Preferred α-olefins are propylene and 1-butene. The former is more preferred.

No particular limitation is imposed on the content of Component (D) in the lubricant composition of the present invention. The lower limit content is preferably 0.1 percent by mass or more, and more preferably 0.3 percent by mass or more, based on the total mass of the lubricant composition, while the upper limit content is preferably 20 percent by mass or less, and more preferably 15 percent by mass or less. Component (D) of less than 0.1 percent by mass would be poor in the effect of enhancing the abilities to inhibit sludge formation and to suppress the increase of the viscosity occurring when being mixed with soot. Component (D) in excess of 20 percent by mass would deteriorate the low-temperature flowability of the resulting lubricant composition.

In the present invention, the blend of the above-described Components (A) thorough (C) with a lubricant base oil makes it possible to produce a lubricant composition which can exhibit the excellent effects to inhibit sludge formation and the increase of the viscosity occurring when being mixed with soot. However, the further addition of Component (D) is contributive to the production of a lubricant composition which are superior particularly in these effects.

For the purpose of further enhancing these properties of the lubricant composition, it may be blended with known lubricant additives such as ashless dispersants other than Components (A), viscosity index improvers other than Components (D), friction modifiers, extreme pressure agents, antiwear agents, rust inhibitors, corrosion inhibitors, oxidation inhibitors, pour point depressants, rubber swelling agents, anti-foaming agents and dyes. These additives may be used singlely or in combination.

Examples of ashless dispersants other than Component (A) are mono type- or bis type-succinimides having a polybutenyl group with a molecular weight of 700 to 3,500, benzylamines, alkylpolyamines, and those modified with boric compounds or sulfuric compounds.

Examples of viscosity index improvers other than Components (D) are non-dispersion type polymethacrylates, non-dispersion type olefin copolymers, and hydrides thereof.

Examples of friction modifiers are organic metal-based friction modifiers containing molybdenum compounds such as molybdenumdithiophosphates and molybdenumdithiocarbamates, aliphatic monohydric alcohols having at least one alkyl or alkenyl group having 6 to 30 carbon atoms, fatty acids and derivatives thereof, and aliphatic amines and derivatives thereof.

Eligible extreme pressure additives and antiwear agents are sulfuric compounds and phosphorus compounds. Examples of the sulfuric compounds are disulfides, olefin sulfides, and sulfurized fats and oils. Examples of the phosphorus compounds are phosphates, amine salts of phosphates, and phosphites.

Examples of the rust inhibitors are alkenyl succinic acids, alkenylsuccinates, polyalcohol esters, petroleum sulfonates, dinonylnaphthalene sulfonates.

Examples of the corrosion inhibitors are benzotriazole-, thiadiazole-, and imidazole-based compounds.

Examples of oxidation inhibitors are phenol-, bisphenol- and ester bond-containing phenol-based oxidation inhibitors and amine-based oxidation inhibitors.

Examples of pour point depressants are polymers suitable for a lubricant base oil to be used, such as polyacrylates and polymethacrylates.

Examples of anti-foaming agents are slicones such as dimethylsilicone and fluorosilicone.

No particular limitation is imposed on the content of these additives. The content of anti-foaming agent is 0.005 to 1 percent by weight, based on the total mass of the lubricant composition. The content of antiwear agents is 0.005 to 1 percent by weight, based on the total mass of the lubricant composition. The content of each of the other additives is 0.05 to 15 percent by weight, based on the total mass of the lubricant composition.

The lubricant composition of the present invention is preferably used as gasoline engine oils for automobiles and motorcycles and also used in place of lubricants having a problem of sludge formation caused by deterioration of a lubricant by being heated or oxidized, such as diesel engine oils, gear oils for automobiles, fluids for automatic transmission and continuously variable transmissions, shock absorber oils, and hydraulic oils.

The present invention will be described in more details with reference to the following examples and comparative examples but are not limited thereto.

EXAMPLES 1 TO 8, AND COMPARATIVE EXAMPLES 1 TO 5

Lubricant compositions of Examples 1 to 8 according to the present invention are prepared in accordance with the formulations indicated in Table 1. Each of the compositions was subjected to the following test for evaluating the properties and the results are also shown in Table 1. Lubricant compositions of Comparative Examples 1 to 5 were also prepared in accordance with the formulations indicated in Table 1. These compositions were also subjected to the same test, and the results are shown in Table 1 as well.

[Test for Evaluating the Ability to Inhibit Sludge Formation]

2.5 g of tetralin and 2 g of dicyclopentadiene were added to 50 g of each lubricant composition. An NOx mixed gas (NO concentration: 5,000 ppm) was blown into the mixture maintained at a temperature of 140° C., at a rate of 160 ml/minute. After 16 hours, the insoluble n-pentane (A method) of each composition was measured in accordance with "Test Method of Insolubles in Used Lubricant" prescribed in JPI 5S-18-80.

This test evaluates the ability to inhibit sludge formation of engine oils. The less value indicates better in the ability to inhibit sludge formation.

TABLE 1

| | Examples | | | | | | | |
|---|---|---|---|---|---|---|---|---|
| | 1 | 2 | 3 | 4 | 5 | 6 | 7 | 8 |
| refined mineral oil*1 mass % | 90.5 | 90.5 | 89.5 | 85.5 | 89.5 | 87.5 | 85.5 | 85.5 |
| (A) succinimide A*2 mass % | 5.0 | | 5.0 | 5.0 | 5.0 | 5.0 | 5.0 | 5.0 |
| (A) succinimide B*3 mass % | | 5.0 | | | | | | |

TABLE 1-continued

| | | | | | | | | |
|---|---|---|---|---|---|---|---|---|
| succinimide C*4 mass % | | | 1.0 | | | | | |
| (B) zinc dithiophosphate*5 mass % | 1.5 | 1.5 | 1.5 | 1.5 | 1.5 | 1.5 | 1.5 | 1.5 |
| (B) amount of phosphorus mass % | (0.09) | (0.09) | (0.09) | (0.09) | (0.09) | (0.09) | (0.09) | (0.09) |
| (C) Ca sulfonate*6 mass % | 3.0 | 3.0 | 3.0 | 3.0 | | | 3.0 | 3.0 |
| (C) Ca phenate*7 mass % | | | | | 4.0 | | | |
| (C) Ca salicylate*8 mass % | | | | | | 6.0 | | |
| (C) amount of sulfated ash mass % | (1.3) | (1.3) | (1.3) | (1.3) | (1.3) | (1.3) | (1.3) | (1.3) |
| (D) viscosity index improver A*9 mass % | | | | | | | 5.0 | |
| (D) viscosity index improver B*10 mass % | | | | | | | | 5.0 |
| viscosity index improver C*11 mass % | | | | 5.0 | | | | |
| sludge inhibiting capabilities | 0.34 | 0.33 | 0.3 | 0.32 | 0.32 | 0.33 | 0.20 | 0.19 |
| n-pentane insolubles (A method) mass % | | | | | | | | |

| | Comparative Examples | | | | |
|---|---|---|---|---|---|
| | 1 | 2 | 3 | 4 | 5 |
| refined mineral oil*1 mass % | 95.5 | 90.5 | 89.5 | 92.0 | 93.5 |
| (A) succinimide A*2 mass % | | | | 5.0 | 5.0 |
| (A) succinimide B*3 mass % | | | | | |
| succinimide C*4 mass % | | 5.0 | 5.0 | | |
| (B) zinc dithiophosphate*5 mass % | 1.5 | 1.5 | 1.5 | | 1.5 |
| (B) amount of phosphorus mass % | (0.09) | (0.09) | (0.09) | (0) | (0.09) |
| (C) Ca sulfonate*6 mass % | 3.0 | 3.0 | | 3.0 | |
| (C) Ca phenate*7 mass % | | | 4.0 | | |
| (C) Ca salicylate*8 mass % | | | | | |
| (C) amount of sulfated ash mass % | (1.3) | (1.3) | (1.3) | (1.3) | (0) |
| (D) viscosity index improver A*9 mass % | | | | | |
| (D) viscosity index improver B*10 mass % | | | | | |
| viscosity index improver C*11 mass % | | | | | |
| sludge inhibiting capabilities | 1.89 | 0.68 | 0.71 | 1.68 | 0.97 |
| n-pentane insolubles (A method) mass % | | | | | |

1) hydro-refined mineral oil (kinematic viscosity:4 $mm^2/s$ at 100° C., viscosity index:120)

2) mono substituted amide type bispolyisobutenyl succinimide represented by the following formula (diluted product nitrogen content 2.1% by mass)

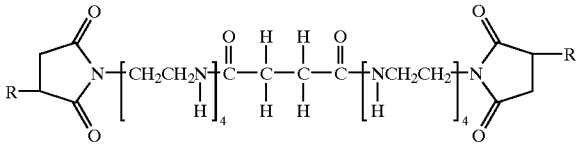

R:polyisobutenyl group derived from polyisobutene having a number-average molecular weight of 1,000

3) mono substituted amide type bispolyisobutenyl succinimide represented by the following formula (diluted product:nitrogen content 2.0% by mass)

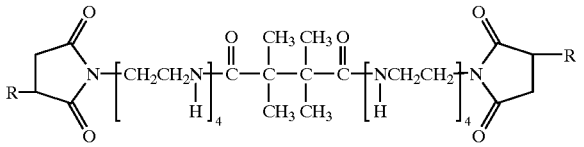

R:polyisobutenyl group derived from polyisobutene having a number-average molecular weight of 1,000

4) bispolybutenyl succinimide (bis type, number-average molecular weight of polybutenyl group:1,000, nitrogen content:2.0% by mass)

5) zinc dialkyldithiophosphate (zinc content:8.2% by mass, phosphorus content:6.3% by mass) alkyl group 2-ethylhexyl group 6) overbased calcium sulfonate containing calcium carbonate (total base number:320 mgKOH/g, calcium content 12.5% by mass, sulfated ash content 42.5% by mass)

7) overbased calcium phenate containing calcium carbonate (total base number:250 mgKOH/g, calcium content 9.25% by mass, sulfated ash content:31.5% by mass)

8) overbased calcium salicylate containing calcium carbonate (total base number:170 mgKOH/g, calcium content 6.3% by mass, sulfated ash content:21.4% by mass)

9) viscosity index improver A:dispersion type, copolymer of ethylene, propylene, and 2-methyl-5-vinylpyridine, weight-average molecular weight 260,000, nitrogen content:0.04% by mass 10) viscosity index improver B:dispersion type, copolymer of alkylmethacrylate having 1 to 18 carbon atoms and N-vinylpyrrolidone, weight-average molecular weight:230,000, nitrogen content:0.15% by mass 11) viscosity index improver C:non-dispersion type, ethylene-propylene copolymer, weight-average molecular weight:330,000

As apparent from the results shown in Table 1, all of the lubricant composition prepared in Examples 1 to 8 had an excellent capability to inhibit sludge formation. Particularly, the lubricant compositions blended with Component (D), i.e., a dispersion type viscosity index improver exhibited a more excellent capability to inhibit sludge formation.

Whereas, the lubricant compositions of Comparative Example 1 where Component (A) was not contained, Comparative Examples 2 and 3 where a conventional succinimide was used instead of Component (A), Comparative Example (4) where Component (B) was not contained, and Comparative Example 5 where Component (C) was not contained, were extremely large in the amount of sludge, compared with the lubricant composition of Examples 1 to 8 and thus are inferior in capabilities of lubricants.

As described above, the present invention can provide a lubricant composition which exhibits an extremely excellent capability to inhibit sludge formation.

What is claimed is:

1. A lubricant composition which comprises a lubricant base oil, and (A) a mono substituted amide type bissuccinimide in an amount from 0.5 to 20 percent by mass represented by formula (1) $R^5$ and $R^6$ are each independently a straight-chain or branched alkyl or alkenyl group having 40 to 400 carbon atoms, and a and b are each independently an integer of 1 to 5, below or derivatives thereof, (1)

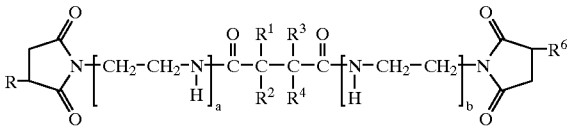

wherein $R^1$, $R^2$, $R^3$, and $R^4$ are each independently selected from the group consisting of hydrogen, an alkyl or alkenyl group having 1 to 24 carbon atoms, and an alkoxy group having 1 to 24 carbon atoms, $R^5$ and $R^6$ are each independently a straight-chain or branched alkyl or alkenyl group having 40 to 400 carbon atoms, and a and b are each independently an integer of 1 to 5, (B) zinc dithiophosphate in an amount from 0.05 to 0.3 percent by mass of phosphorus, and (C) a metal-based detergent in an amount from 0.5 to 4.0 percent by mass of sulfated ash, based on the total mass of the composition.

2. The lubricant composition according to claim 1 which further comprises (D) a dispersion type viscosity index improver in an amount from 0.1 to 20 percent by mass, based on the total mass of the composition.

3. The lubricant composition according to claim 1 wherein said zinc dithiophosphate is a compound represented by the formula (4)

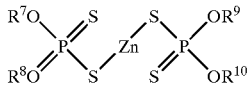

wherein $R^7$, $R^8$, $R^9$, and $R^{10}$ are each independently selected from the group consisting of an alkyl or aryl group having 1 to 18 carbon atoms and an alkylaryl group having 7 to 18 carbon atoms.

4. The lubricant composition according to claim 1 wherein said metal-based detergent is one or more members selected from the group consisting of alkaline earth metal sulfonates having a total base number of 20 to 500 mgKOH/g; alkaline earth metal phenates having a total base number of 20 to 450 mgKOH/g; and alkaline earth metal salicylates having a total base number of 20 to 450 mgKOH/g.

5. The lubricant composition according to claim 2, wherein said dispersion type viscosity index improver is one or more member selected from the group consisting of dispersant type polymethacrylates, dispersant type ethylene-α-olefin copolymers, and hydrides thereof.

6. The lubricant composition according to claim 1 which further comprises one or more additives selected from the group consisting of ashless dispersants other than said Component (A), viscosity index improvers other than said Component (D), friction modifiers, extreme pressure agents, antiwear agents, rust inhibitors, corrosion inhibitors, oxidation inhibitors, pour point depressants, rubber swelling agents, anti-foaming agents and dyes.

* * * * *